US006080029A

United States Patent [19]

Johnson et al.

[11] Patent Number: 6,080,029

[45] Date of Patent: Jun. 27, 2000

[54] METHOD OF MANUFACTURING A SPARK PLUG WITH GROUND ELECTRODE CONCENTRICALLY DISPOSED TO A CENTRAL ELECTRODE

[75] Inventors: James E. Johnson; Charles R. Rasnic, both of Hot Springs, Ark.

[73] Assignee: Halo, Inc., Hot Springs, Ark.

[21] Appl. No.: 09/368,760

[22] Filed: Aug. 5, 1999

[51] Int. Cl.[7] ..... H01T 1/22

[52] U.S. Cl. ..... 445/7

[58] Field of Search ..... 313/141, 142; 445/7

[56] References Cited

U.S. PATENT DOCUMENTS

| | | | |
|---|---|---|---|
| 4,268,774 | 5/1981 | Forkum, Jr. . | |
| 4,810,220 | 3/1989 | Moore . | |
| 5,092,803 | 3/1992 | Johnson . | |
| 5,280,214 | 1/1994 | Johnson | 313/141 |
| 5,408,961 | 4/1995 | Smith | 123/169 R |
| 5,430,346 | 7/1995 | Johnson | 313/141 |

*Primary Examiner*—Kenneth J. Ramsey

*Attorney, Agent, or Firm*—Larson & Larson, P.A.; James E. Larson

[57] ABSTRACT

A spark plug for an internal combustion engine is provided with a double ringed ground electrode permanently affixed to the spark plug base. One ring is used for the attachment and the other, held apart by one or more legs, is suspended circumferentially and perpendicular to the longitudinal axis of the spark plug a set distance from the center electrode. The method of manufacturing a spark plug comprises the steps of providing a spark plug base, providing a ring shaped ground electrode with enhancements to accomplish shielding and centering of the piece, providing a welding apparatus for rotable welding of said ring shaped ground electrode to said spark plug base, providing an alignment tool for aligning said ring shaped ground electrode with said spark plug base, aligning the ring shaped ground electrode with said spark plug base and welding the ring shaped ground electrode to said spark plug base to form a spark plug.

7 Claims, 8 Drawing Sheets

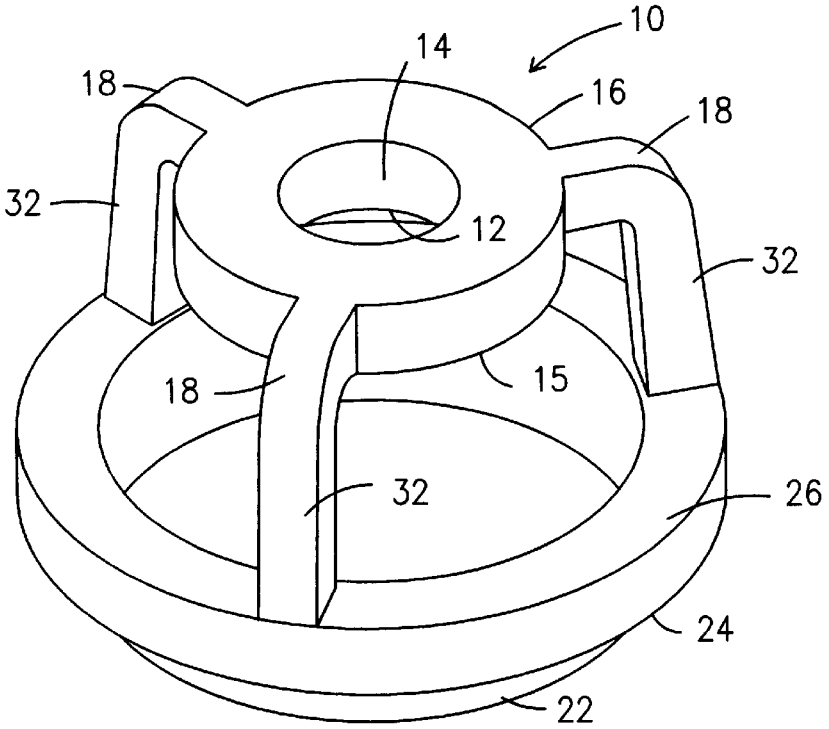
Fig. 3
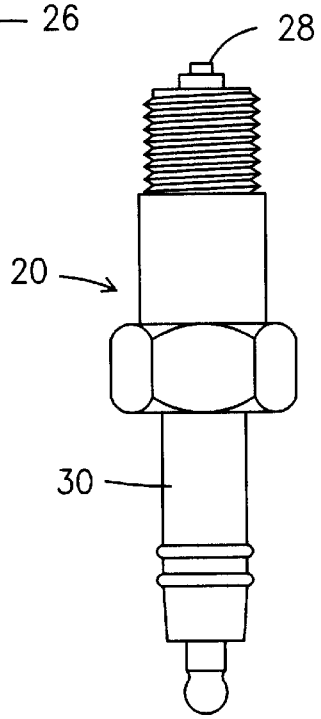
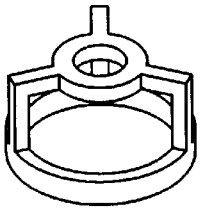
Fig. 1
PRIOR ART
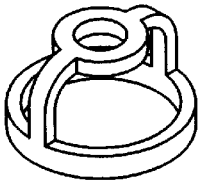
Fig. 2
PRIOR ART
Fig. 4

METHOD OF MANUFACTURING A SPARK PLUG WITH GROUND ELECTRODE CONCENTRICALLY DISPOSED TO A CENTRAL ELECTRODE

BACKGROUND OF THE INVENTION

1. Field of the Invention

This invention relates to a new and improved method for manufacturing spark plugs used in internal combustion engines. More particularly, it refers to a method of attaching a ground electrode to a spark plug base. One such embodiment includes a ring or ring segment internal opening concentrically disposed with respect to a center electrode onto a metal housing of the spark plug. An additional embodiment includes a ring or ring segment internal opening concentrically disposed with respect to a center electrode containing various precious metals on the firing surfaces onto a metal housing of the spark plug.

2. Description of the Prior Art

Commercial internal combustion engine spark plugs in current widespread use have characteristically had a center electrode with an exposed end in its base that is spaced apart from a ground electrode. The ground electrode is usually an "L" shaped single arm welded to an edge of the plug and bent over towards the center electrode at substantially a right angle. Although these plugs perform their intended function, it has been determined that their design substantially detracts from a complete burn Otto cycle in an internal combustion engine's combustion chamber and results in the overheating of the plug parts, incomplete combustion and the production of oxides of nitrogen in the combustion chamber.

Spark plugs are a critical component in an internal combustion engine to assure proper engine performance. Spark plugs include a metal housing which is threaded for installation into the engine, a ground electrode extending from the housing, an insulator (usually manufactured of a ceramic material) carried by the housing, with a center electrode within the insulator, on end of which projects from the end of the insulator and defines a pre-determined gap with the ground electrode. When the spark plug is fired, the spark is generated across the gap. More recently, spark plugs have been designed with a fine wire tip made of a noble metal (platinum or platinum alloy) that has significantly improved engine performance and significantly increased spark plug life. Platinum fine wire spark plugs improve cold starting, acceleration and fuel economy of the engine, as compared to spark plugs not having a platinum firing tip and have a service life of up to 100,000 miles.

Improvements on the design of the ground electrode include U.S. Pat. Nos. 5,280,214, 5,430,346 and U.S. Pat. No. 4,268,774, all incorporated herein by reference. In a preferred embodiment of these ground electrodes, a ring shaped firing surface is attached to an end of one or more integral mounting posts. Each integral mounting post is attached at a second end to a mounting ring. The mounting ring is then seated onto a mounting surface at the bottom end of a spark plug. The known methods of attaching these ground electrodes to the bottom end of the spark plug include eliminating the mounting ring and tack welding the second end of the mounting post directly to an edge of the bottom end of the spark plug, or a plurality of metal surfaces extending above the shoulder on the bottom end of the spark plug are bent over to crimp the mounting ring to secure it to the bottom end. These methods of manufacture have proved to be time consuming, costly and have resulted in poor efficiency and reduction in useful life of the spark plug, as opposed to its potential for being an integral, important means by which internal optimum combustion engine efficiency and output can be attained.

SUMMARY OF THE INVENTION

This invention describes a method of manufacturing a spark plug for an internal combustion engine. In one embodiment the methods described herein are particularly useful for affixing a concentrically disposed ground electrode to a spark plug base.

A double ring ground electrode is permanently affixed to the spark plug base using the bottom ring which is always larger in diameter from the top ring. A welding apparatus is employed for rotable welding the bottom ring to the base while providing an alignment tool to align the double ring ground electrode with the spark plug base. A lip is provided along the lower edge of the bottom ring to prevent welds from damaging the interior of the spark plug.

The object of the present invention is to provide process improvements to the method of manufacturing an existing ground electrode tip attached to the metal rim in a spark plug insulator. This method is performed both before or after the center electrode is inserted and sealed in the spark plug body. The method described in detail is that of affixation after the center electrode has been inserted and sealed in the spark plug body. The only difference is that if the center electrode is inserted and sealed after the ground electrode tip has been affixed to the spark plug body the alignment must occur at that time.

BRIEF DESCRIPTION OF FIGURES

FIG. 1 is a prior art three-post ground electrode tip;

FIG. 2 is a prior art two leg alternative embodiment of a ground electrode tip;

FIG. 3 is a prospective view of an enhanced three post ground electrode used in the method of this invention;

FIG. 4 is an elevational view of a standard plug body without a ground electrode;

DESCRIPTION OF PREFERRED EMBODIMENTS

With reference to FIG. 1 and FIG. 2, existing prior art ground electrode tips are shown. The improved ground electrode as shown in FIG. 3 is used in the method of this invention where a ground electrode is concentrically disposed to a central electrode, the ground electrode having as few as three mounting posts up to multiple posts spaced around 360 degrees, but not becoming solid.

FIG. 1 shows a ground electrode tip as contained in U.S. Pat. No. 5,280,214 and 5,430,346. FIG. 2 shows this same electrode with radii added to all non-firing surface corners. These radii can vary from 0.001" to half of the particular section thickness. Section thicknesses on the bottom and top rings and the mounting posts vary depending on specific applications. The radii create smooth transition surfaces that are much less susceptible to "hot spots" developing during continued combustion. "Hot spots" are the primary source of pre-ignition in an internal combustion engine, which results in premature wear, stress and failure of engine components. Conventional "L" shaped ground electrodes do not make accommodation for radii on corner surfaces. Radii on non-firing surfaces drastically reduces the possibility of pre-ignition. In addition, the elimination of sharp corners on all non-firing surfaces reduces the likelihood of the plug firing to the wrong surface.

Figure 5:
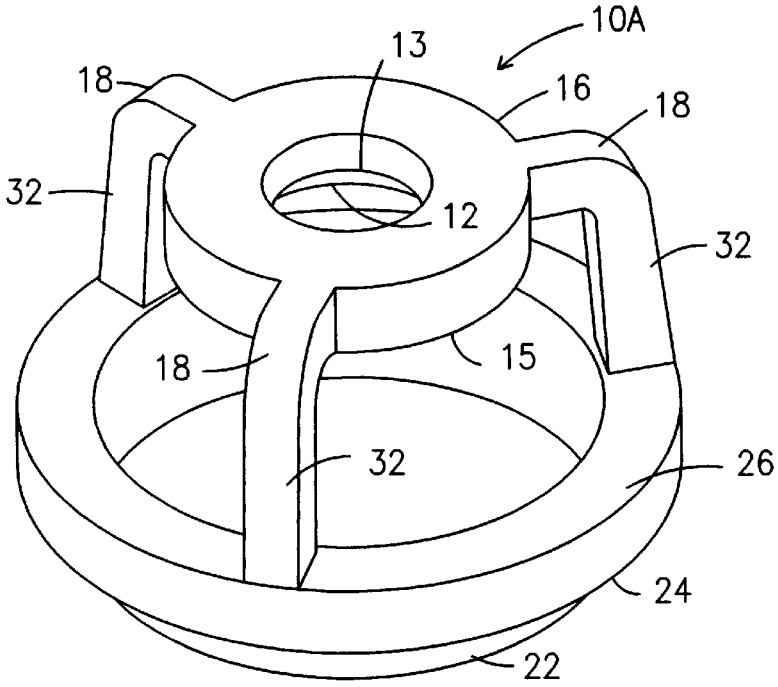
FIG. 5 is a prospective view of a variant from FIG. 3 with a bottom edge of the top ring chamfered.

Referring to FIG. 3, the double ring ground electrode 10 has sharp corners 12 on the firing surface (the inside edge of the hole 14 in the upper ring 16) of the ground electrode 10. This provides the necessary geometry to optimize firing of the plug around the entire top ring 16. Further, radii 18 on non-firing surfaces improves structural rigidity and reduces the number of stress concentrations that could cause irregular expansion movement as temperatures increase. The post mounted nature of the design also provides for more turbulence of the gas mixture during flame development, aiding in a more complete burn of the mixture. In an alternative design, the edge 12 can be chamfered 13 as seen in FIG. 5 to increase surface area of the spark burn.

The method of manufacturing the spark plug tip 10 is unique. Conventional ground electrodes are made from extruded wire rolls that are cut, welded and then formed over to create the gap. This process is somewhat random, as the forming of the wire induces internal stresses in the metal, resulting in substantial variances from the desired optimum. It is difficult to ensure an exact, repeatable gap with this method of manufacture. Additionally, under engine firing conditions, the combustion chamber temperatures cause the gap to change as a function of the expansion coefficient of the metal. Additional more unpredictable movement of the ground electrode is caused by the temperature relief of the internal stresses created as a result of the bending operation during plug manufacture. Since the conventional ground electrode is only supported in one place, the movement during expansion possesses several degrees of freedom, thereby allowing random movement that compromises the desired parallelism and gap of the plug. With the tip 10, the method of manufacture is simplified to a single attachment step of a finished geometry part. The tips 10 are manufactured by the process of metal injection molding, sintering, casting, or stamping, with the preferred method being metal injection molding. Once the molded part is completed, no additional processing of the tip 10 is required either before or after it is attached to the spark plug body 20. Internal stresses and weakening of the metal through secondary operations are thereby eliminated since the part as molded is ready for attachment. Because of the geometry and symmetry of the tip 10, thermal expansion during combustion is controlled and degrees of freedom of movement are limited primarily to one direction. This helps ensure better alignment and gap control, which enhances the plug performance over all operating ranges. The tip 10 on a spark plug body 20 is the only true, maintainable factory gapped plug. Conventional and multiple electrode plugs, as well as those with platinum on the firing surfaces claim a factory preset gap. However, if the L shaped end is bumped, even slightly (such as when it is installed in an engine), the gap could be compromised. With the tip 10, this is not the case. Because of its three-post 32 support, a substantial striking force on the tip is necessary to change the gap appreciably.

Figure 6:
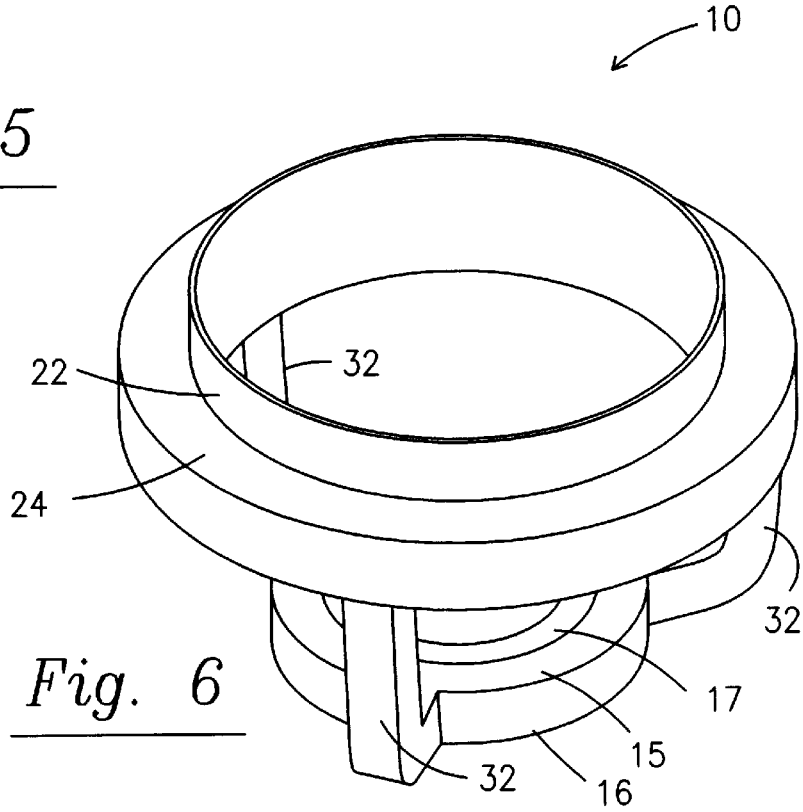
FIG. 6 is a reversed prospective view of the electrode of FIG. 3 with a platinum insert on a bottom surface of the top ring.

The tip 10 is unique in that it improves exposure to the fuel mixture coming into the combustion chamber and provides for better resistance to spark degradation under high-pressure conditions. As shown in FIG. 3, the hole 14 in the middle of the upper ring 16 provides a direct path for the fuel to reach the spark, as opposed to the conventional L-shaped ground electrode, which shields the spark from the gas in many instances. This reduced lag time to begin combustion helps improve fuel usage and emissions by allowing for a more complete burn of the mixture. The fuel mixture does not have to go around the electrode to initiate combustion. The configuration of the tip 10 is also such that under high compression pressure conditions, the spark actually appears to move up under the edge 12 of the firing surface 15 of the top ring 16. With an infinite number of potential firing paths (versus typically only one with a conventional electrode), the spark has a dramatically reduced potential for being extinguished. A platinum insert 17 can also be added to the firing surface 15 (see FIG. 6).

With continuing reference to FIG. 3, the tip 10 also features a centering/shielding lip 22 below the bottom surface 24 of the bottom ring 26. This lip 22 serves two purposes. First, it provides centering of the tip 10 with respect to the plug body during manufacture, which is critical to proper functioning of the tip 10. Secondly, lip 22 prevents splatter of the molten metal during the manufacturing process onto the center electrode 28 of the plug 20, an occurrence that could be fatal to finished plug operation. Additionally, during laser welding, the lip 22 serves a similarly important function of shielding the center electrode 28 and porcelain 30 of the plug body 20 from stray radiation. Initial tests showed that even a minute gap between the lip 22 and plug body 20 allowed the laser beam to reach and damage the center electrode 28. The lip 22 enhancement prevents this as well as preventing a small gap from being fatal to the plug body 20. The lip 22 permits enhanced manufacturing output of the tip 10 onto the plug body 20. In addition, the continuous bottom ring 26 on the enhanced version of the tip 10 provides for less localized heat buildup during attachment of the tip 10 to the plug body 20. This enhances function by providing a balanced resistance path, thereby minimizing point conduction that could be detrimental to overall performance.

The method of attaching the tip 10 to the plug body 20 is also unique. Conventional L and multiple L electrodes are attached to the plug body 20 by cutting and fusion welding a wire electrode on to one or several sides of the plugs, then bending the wire over to achieve the desired gap. The ground electrode's 10 double ring configuration lends itself to a method of attachment that is singularly different than other conventional plugs. With its continuous bottom ring 26 arrangement, the tip 10 can be attached via a continuous weld. This weld provides for a stronger bond than a standard electrode and helps balance the heat and resistance conduction paths. This fusion also reduces the likelihood of the aforementioned "hot spots" by equalizing heat conduction around the bottom ring 26 and providing a balance of heat and electrical resistance up the posts 32 to the top ring 16. By eliminating heat and resistance gradients, no adverse conduction paths that could negatively affect the firing tendencies are generated.

Fusion of the enhanced tip 10 can be accommodated by several means. FIGS. 7–12 depict the preferred means of joining the tip 10 to the plug body 20. Although Gas-Tungsten Arc welding, Laser and Plasma welding are the only means depicted, attachment could be made by any standard or modified welding method.

Figure 7:
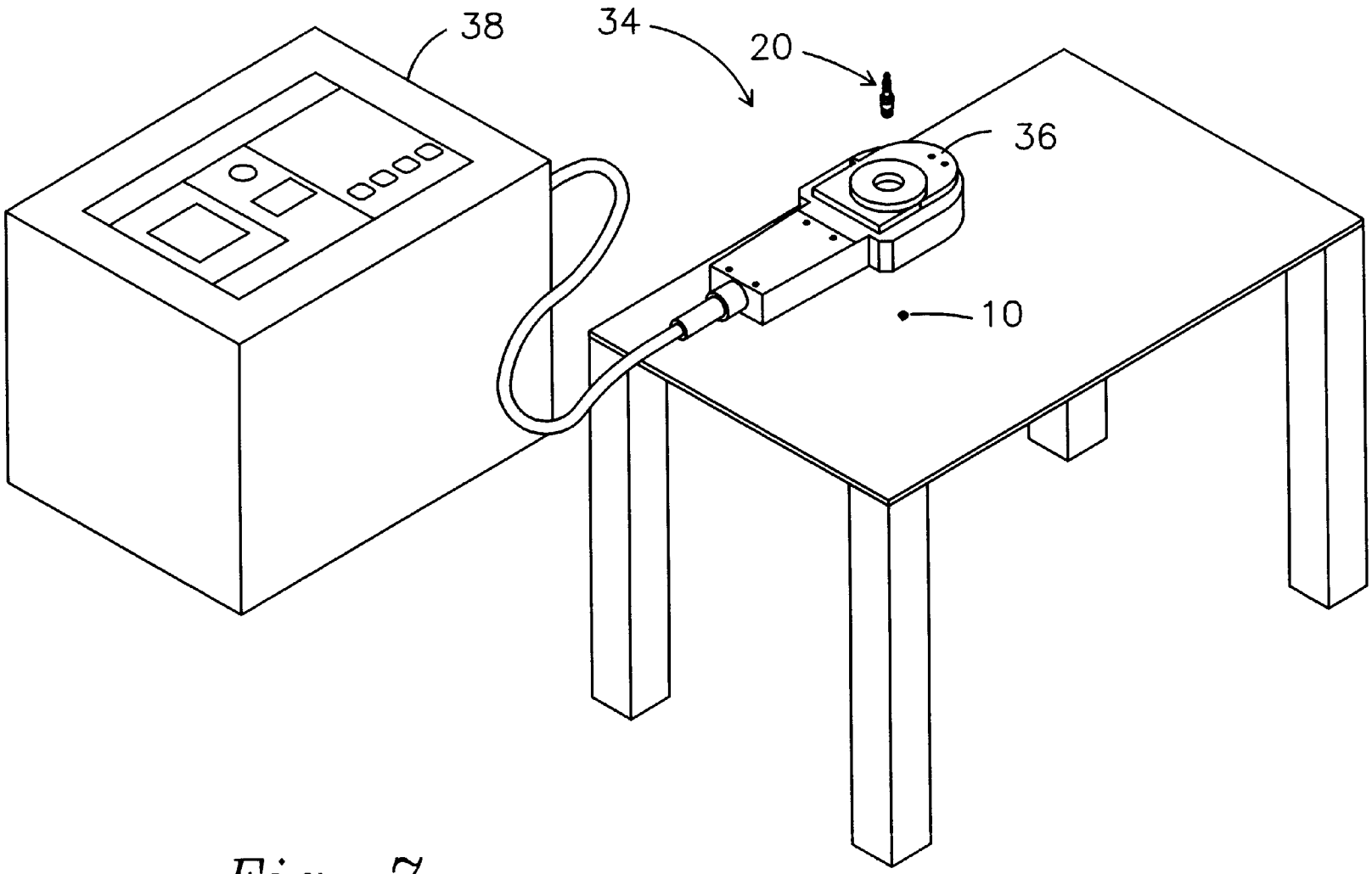
FIG. 7 is a view of the manufacturing method utilizing a Gas-Tungsten Arc Welding attachment means to join the enhanced ground electrode tip of FIG. 3 to the spark plug by a manual loading/unloading method.

FIG. 7 shows the method of attachment utilizing Gas-Tungsten Arc welding (GTAW), more commonly referred to as TIG (Tungsten-Inert Gas). In this method, the preferred embodiment is a manual or automatically cycled orbital welding machine 34. A stationary weld head using a part rotating mechanism also could be used. An orbital welding head 36 is attached to a programmable power supply 38 that also serves as a heat exchanger to keep the weld head 36 cool. In the manual loading method, a ground electrode tip 10 is loaded in to one end of the orbital head 36 while the plug body 20 is placed in the other. Fixturing assures proper location of the tip 10 concentric and parallel with the center electrode 28. After loading, the machine is cycled. This cycle consists of an Argon or other suitable inert gas purge of the weld head chamber, cycling of the weld electrode around the parts and a final cooling purge to eliminate oxidation and discoloration of the finished weld. Once the cycle is complete, the finished part is removed from the fixture.

Figure 8:
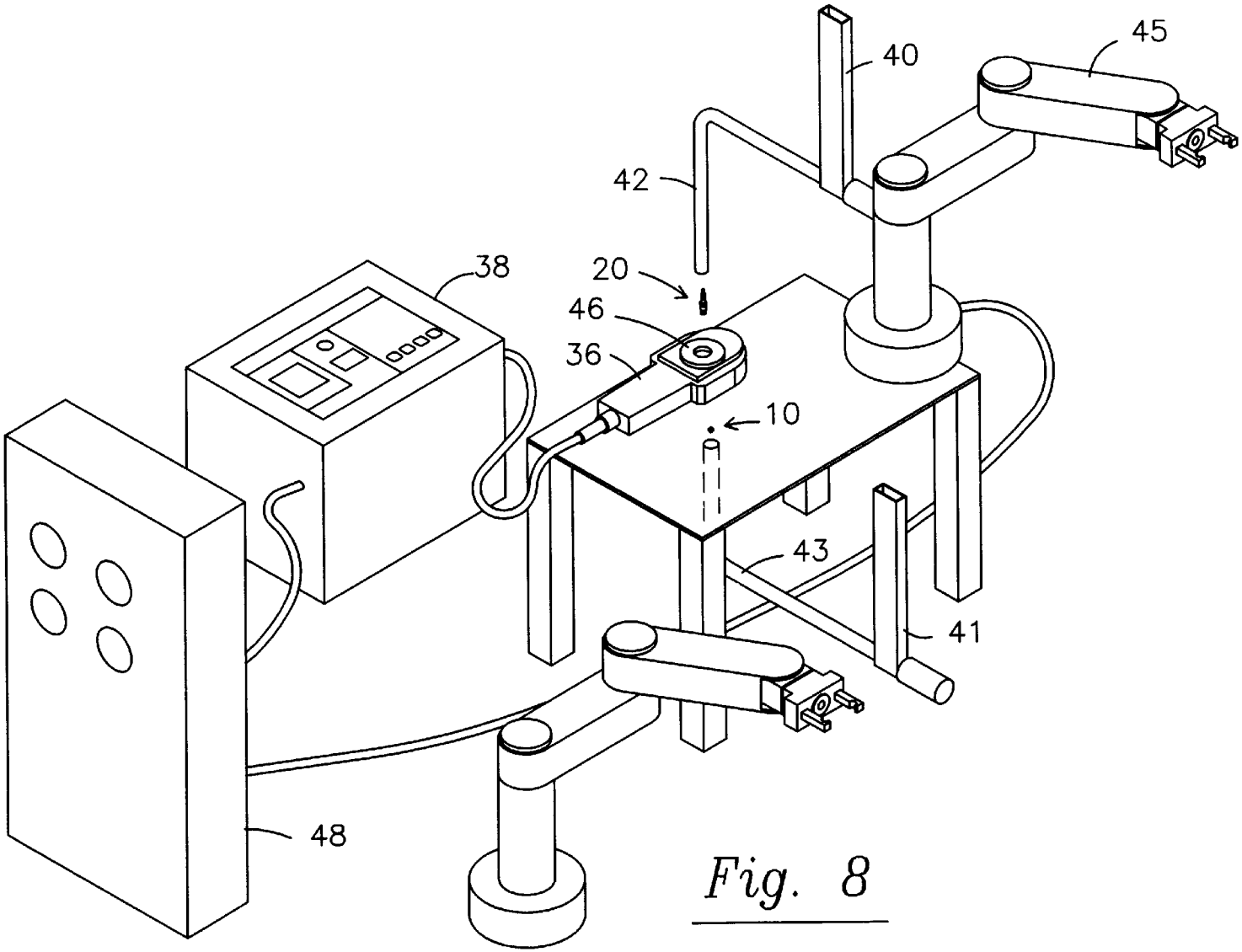
FIG. 8 is a view of the manufacturing method setup utilizing a Gas-Tungsten Arc Welding attachment means to join the enhanced ground electrode tip of FIG. 3 to the spark plug incorporating an automatic loading-unloading method.

Similarly, FIG. 8 denotes the same procedure with the addition of a loading magazine 40 for the plug bodies 20 and a loading magazine 41 for the ground electrode tips 10. A first conveyor 42 directs the plugs 20 to the weld head 36 and a second conveyor 43 directs the tips 10 to the weld head 36 which is accomplished by a pick and place programmable robotic arm 45 (FANUC or equivalent). Removal of the finished part and placement on the packaging conveyor (not shown) is accommodated in like manner. A like method for both the automatic and manual scenarios incorporates a rotator 46 and stationary weld head 36. The means of loading and unloading parts is similar. Interaction of the weld cycle with the placement of parts is accomplished with an Allen-Bradly or similar programmable logic controller 48. Part presence and safety interlocking of critical process components is accommodated through a series of electric eyes and mechanical limit switches. Cycle timing is automatic with capability for manually overriding any portion.

Figure 9:
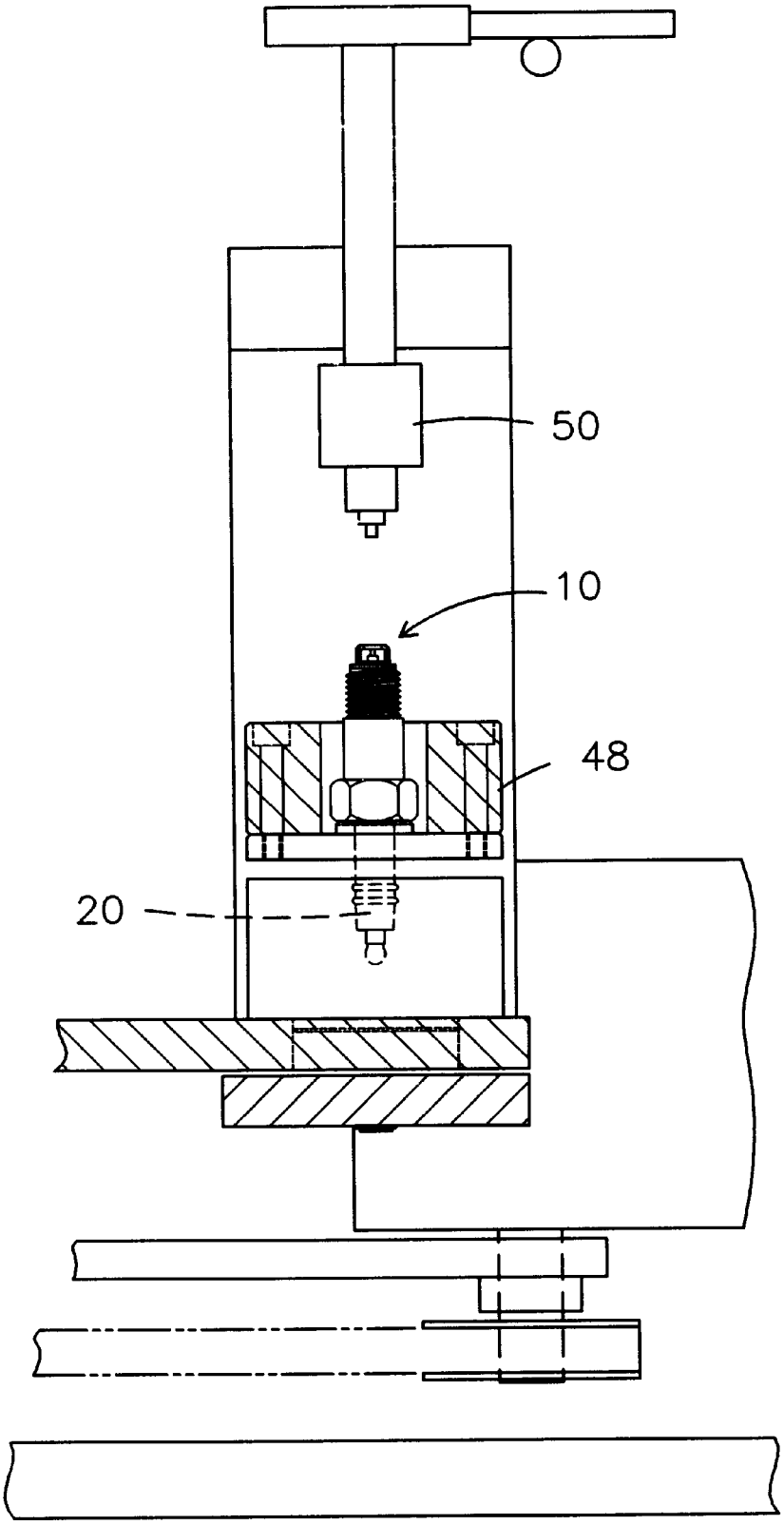
FIG. 9 is a view of the manufacturing method utilizing a laser attachment means to join the ground electrode tip of FIG. 3 to the spark plug by a manual loading/unloading method.

FIG. 9 shows the method of attachment utilizing a laser welder with manually loaded parts. In this method, the laser head is rigidly mounted. Plug bodies 20 and ground electrode tips 10 are loaded into a fixture-rotator mechanism 48 from different directions. A hold down mandrel 50 locates the electrode tip 10 with respect to the plug 20 with the required parallelism and concentricity. The laser weld head 36 (not shown) is attached to a power supply 38 (also not shown) that provides the program cycle necessary for attachment, as well as cooling for weld head 36. Once complete, the finished part is removed from fixture 48 and transferred to the packaging conveyor.

Figure 10:
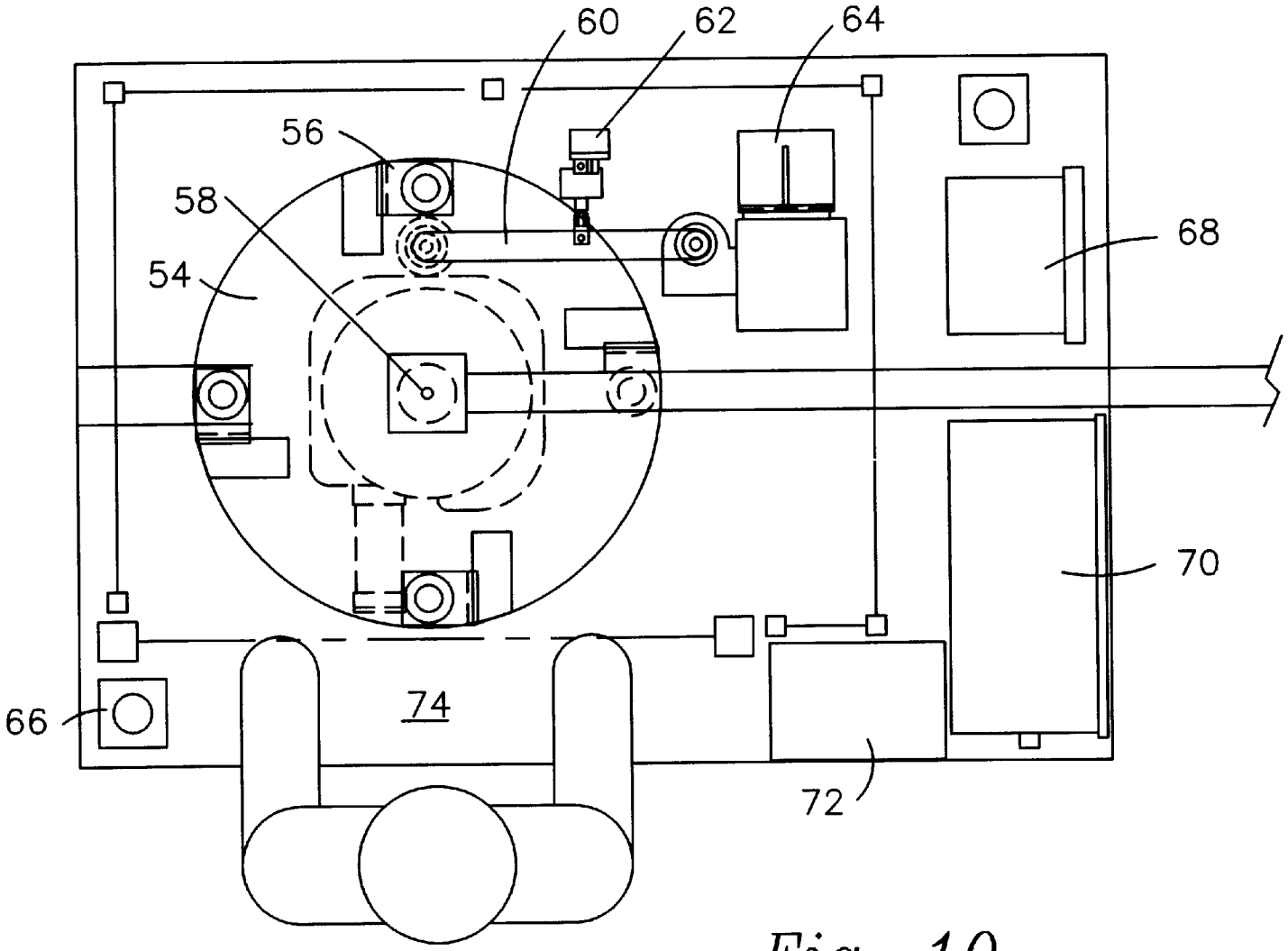
FIG. 10 is a top view of the manufacturing method of FIG. 9 utilizing a laser attachment means to join the ground electrode tip of FIG. 3 to the spark plug incorporating an automatic loading/unloading method.

FIG. 10 carries out a similar attachment principle as shown in FIG. 9, with the exception that the process is automated. A loading magazine is utilized to provide parts to an indexing table 54. Pick and place robotic arms bring the individual tips 10 and plug bodies 20 to a laser weld and rotation station 56. Relative locations are established similar to the manual process depicted in FIG. 7. Interaction of the various components is synchronized with PLC, with interlocking signals on critical components sent by a series of mechanical limit switches, light curtains and optical sensors (not shown). Parts are loaded and welded and then the table is indexed so that the next set can be loaded. Offloading of the finished parts is accomplished by a pick and place robotic arm (not shown) at one of the indexing stations. As shown in FIG. 10, the automated laser welding setup includes indexing table 54, laser weld and rotation station 56, an allen-air indexer 58, a NIP roll drive 60, an electrical indexing stop 62, a Bodine variable speed drive 64, a pair of E-stops 66 located at opposed corners, a light curtain control 68, an electrical control enclosure 70, an operator control panel 72 and a loading/unloading station 74.

Figure 11:
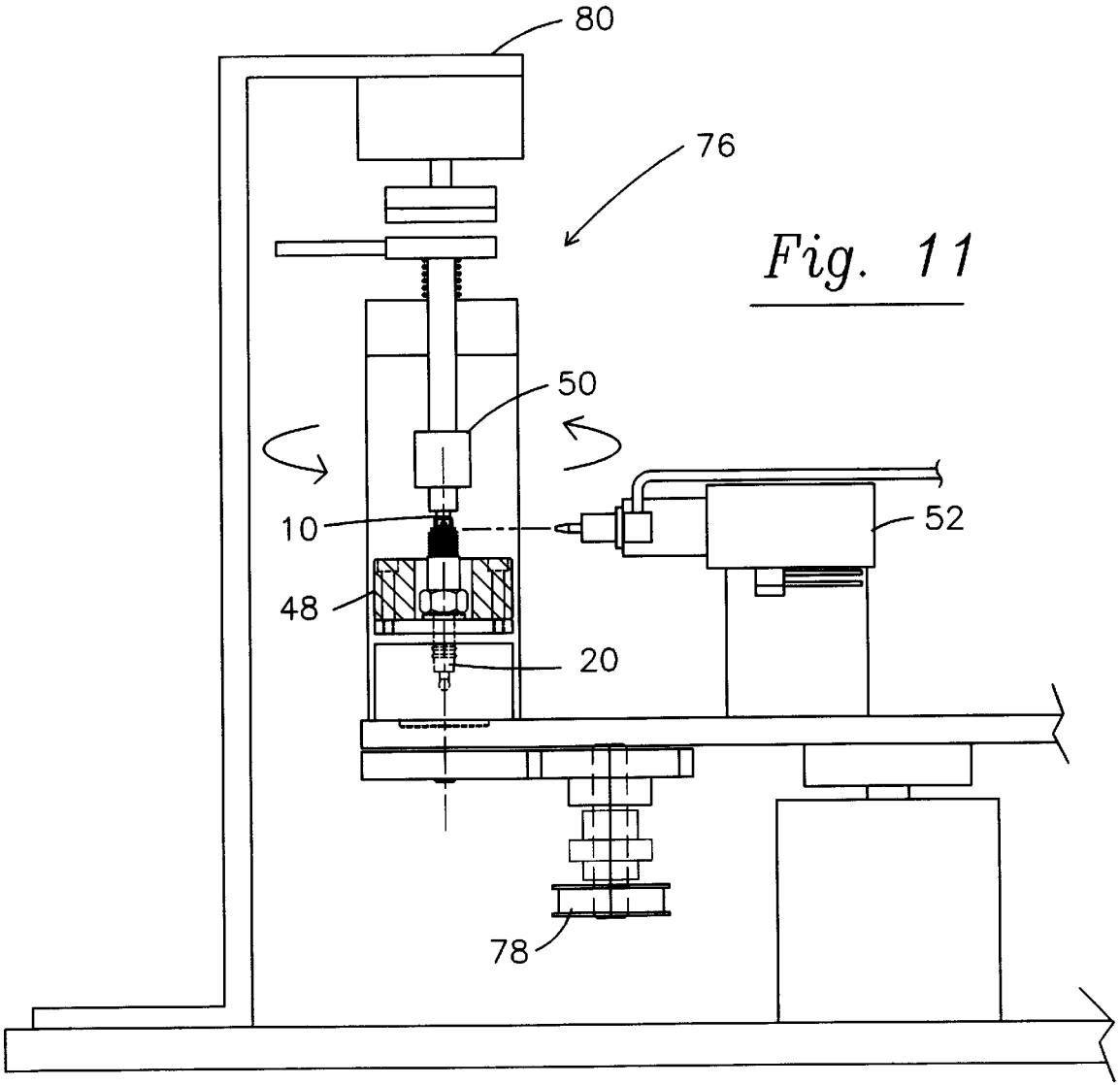
FIG. 11 is a view of the manufacturing method utilizing a plasma attachment means to join the ground electrode tip of FIG. 3 to the spark plug by a manual loading/unloading method.

Referring to FIG. 11, a manual plasma welder 76 is shown which can be used as a method of attachment in the present invention. As shown in FIG. 11, manuel plasma welder 76 includes a plasma welder 52, a rotator pulley 78, plug fixture-rotator mechanism 48, tip locator and hold down mandrel 50 and a mandrel mount 80.

Figure 12:
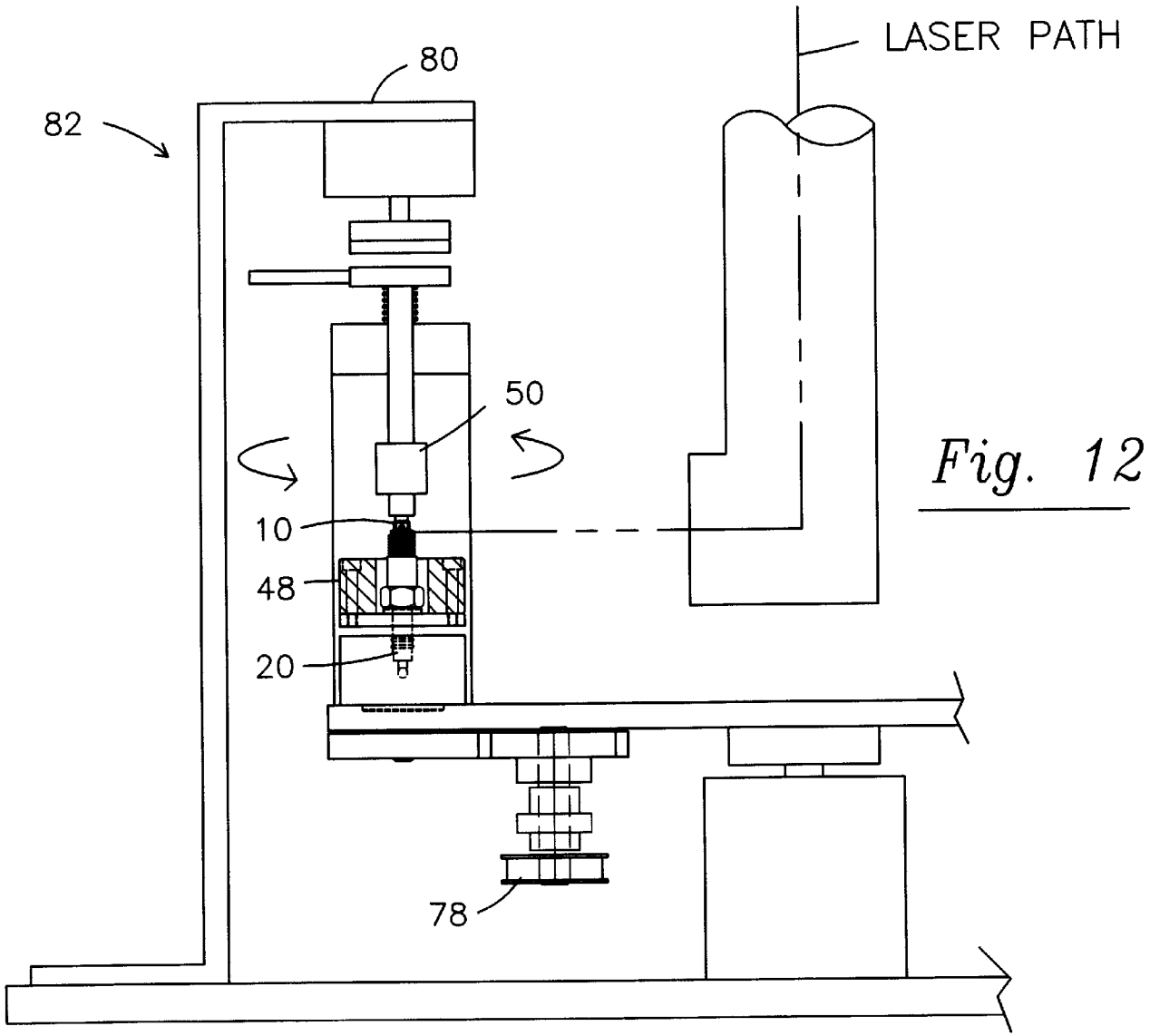
FIG. 12 is a view of the manufacturing method utilizing a plasma attachment means to join the enhanced ground electrode tip of FIG. 3 to the spark plug incorporating an automatic loading/unloading method.

Referring to FIG. 12, an automated plasma welder 82 is shown which can be used as a method of attachment in the present invention. As shown in FIG. 12, automated plasma welder 82 includes a laser pathway, rotator pulley 78, plug fixture-rotator mechanism 48, tip locator and hold down mandrel 50 and mandrel mount 80.

EXAMPLE 1

Emissions Testing Synopsis 97 Dodge Dakota

VIN 1B7GG23Y7V Engine Type—5.2 L Fuel Injected V-8, Electronic Ignition

Vehicle mileage 35,489. Installed Bosch platinum recommended stock plugs (Bosch part number FR8LPX) at 27,143 miles. Total mileage on plugs 8,346 miles. In a range of six plugs of this style, this plug ranks second from the top of the heat range, indicating a hot plug. Nominal gap is 0.045 inch with an allowable range of 0.032 inch to 0.060 inch. Ran vehicle through a four-gas emissions test at Quachita Technical College. At operating temperature, as a baseline, results were taken at idle (600 rpm) and cruise (2500 rpm) engine speeds. Results were as follows:

| | Idle | Cruise |
|---|---|---|
| Carbon Dioxide ($CO_2$) | 14.30% | N/A |
| Carbon Monoxide (CO) | 0.28% | 0.20% |
| Hydrocarbons (HC) | 77 ppm | 7 ppm |
| Oxygen ($O_2$) | 0.77% | N/A |

Plugs were then removed on the spot and replaced with a set of Champion racing plugs that had been modified with a ground electrode 10 as shown in FIG. 3. These plugs unmodified are a part number C57C and are listed as a high-performance plug in Champion's catalog. In grouping of eight plugs in this category, this plug is the coldest listed for a projected tip plug and is third from the bottom relative to the entire grouping. Unmodified, these plugs would probably not be suitable to run in this engine. Champion's recommended plug for this engine is an RC12LC4, which ranks third from the top of the heat range in this grouping. Significant differences in this modified plug versus the recommended include not only the heat range, but a narrower (0.025 inch) gap and a non-resistor setup. Though no significant differences were expected initially (prior experience showed that it usually took at least 1,000 miles to burn off all of the residual combustion chamber deposits left from the prior plug, sometimes resulting in initially worse emissions), a baseline was run with no miles on the vehicle to get another baseline. Results were surprising as follows:

| | Idle | Cruise | % Change |
|---|---|---|---|
| Carbon Dioxide ($CO_2$) | 14.65% | N/A | +2.4 |
| Carbon Monoxide | 0.04% | 0.25% | −85.7/+25.0 |
| Hydrocarbons (HC) | 12 ppm | 9 ppm | −84.4/+28.6 |
| Oxygen ($O_2$) | 0.51% | N/A | −33.7 |

Drastic reductions in all bad emissions were noted at idle, with the expected increase in $CO_2$ due to more complete burning. The cruise results were expected and should progressively decrease as residual deposits are burned off. Additionally, one of the plugs with tip 10 was cross-threaded during installation and could not be installed. Thus one of the stock plugs was placed back into the engine on the number eight cylinder. Actual results should be even better once the remaining plug with tip 10 is installed.

EXAMPLE 2

Returned to Quachita Vo-Tech for follow up emissions testing. Eight plugs having tips 10 had since been installed in the engine and the mileage was 36,629 (1,140 since last test). It is notable that the check engine light in the Dakota was on at the time of this test, which could indicate a problem with the oxygen sensor. Results were as follows:

| | Idle | Cruise | Orig. Test % Change |
|---|---|---|---|
| Carbon Dioxide ($CO_2$) | 14.89% | 15.26 | +4.1/N/A |
| Carbon Monoxide (CO) | 0.00% | 0.05% | −75.0 |
| Hydrocarbons (HC) | 7 ppm | 22 ppm | −90.0/+214 |
| Oxygen ($O_2$) | 0.39% | 0.25% | −49.4/N/A |

Continued improvements were noted at idle and a drastic improvement in CO emissions noted at cruise. The only parameter that does not make sense is the marked increase in HC emissions at cruise, though this same parameter showed a 91% reduction at idle. This could be a suspect reading, particularly in light of the fact that the $CO_2$ percentage was up (indicating a fuller burn) and $O_2$ percentage was drastically down from idle (also indicating a more complete burn).

EXAMPLE 3

Third test performed at 37,545 miles (916 since prior test). The check engine light was still on. Results as follows:

| | Idle | Cruise | Orig. Test % Change |
|---|---|---|---|
| Carbon Dioxide ($CO_2$) | 14.71% | 15.09 | +2.9/N/A |
| Carbon Monoxide (CO) | 0.00% | 0.01% | ∞/−95.0 |
| Hydrocarbons (HC) | 6 ppm | 8 ppm | −92.2/+14 |
| Oxygen ($O_2$) | 0.64% | 0.39% | −16.8/N/A |

Results continue to improve, both at idle and at cruise. CO approaching zero at cruise now also, with HC showing drastic reduction from prior test. This would indicate that the tips 10 of FIG. 3 are continuing to clean out the combustion chamber deposits left by the original plugs. The pollutant reductions were less than the immediately prior test, despite the apparent burn being not quite as full as indicated by the oxygen and carbon dioxide percentages. The check engine light and/or oxygen sensor could be the limiter here.

Equivalent elements, components and steps can be substituted for the ones set forth above such that they perform the same function in the same way for achieving the same result.

We claim:

1. A process for manufacturing a spark plug for an internal combustion engine, the steps comprising:

(a) providing a double ring ground electrode having at least three legs separating a top ring having a lessor diameter from a bottom ring, the ground electrode having a downwardly displaced lip below the bottom ring;

(b) providing a spark plug base having a porcelain housing and a spark producing electrode centered in one end of the spark plug base;

(c) welding the double ring ground electrode bottom ring to a circumference of the spark plug base surrounding the spark producing electrode; and (d) providing an alignment tool for aligning the double ring ground electrode with the spark plug base so that the top ring of the ground electrode is concentric with and spaced above the spark producing electrode.

2. The process according to claim 1 wherein the double ring ground electrode is rotatably welded to the spark plug base.

3. The process according to claim 1 wherein the welding is carried out with a Tungsten-Inert Gas.

4. The process according to claim 1 wherein the welding is carried out using a laser welder.

5. The process according to claim 1 wherein a bottom surface of the top ring is provided with a platinum insert.

6. The process according to claim 1 wherein the welding is carried out with a plasma welding process.

7. The process according to claim 1 wherein the double ring ground electrode is prepared by injection molding a conductive metal.

* * * * *